United States Patent [19]

Horgan

[11] 4,081,274

[45] * Mar. 28, 1978

[54] COMPOSITE LAYERED PHOTORECEPTOR

[75] Inventor: Anthony M. Horgan, Pittsford, N.Y.

[73] Assignee: Xerox Corporation, Stamford, Conn.

[ * ] Notice: The portion of the term of this patent subsequent to Apr. 27, 1993, has been disclaimed.

[21] Appl. No.: 737,251

[22] Filed: Nov. 1, 1976

[51] Int. Cl.[2] ..... G03G 5/04; G03G 5/09

[52] U.S. Cl. ..... 96/1 PC; 96/1.5 R

[58] Field of Search ..... 96/1 R, 1.5, 1.6, 1 PC; 260/570 R

[56] References Cited

U.S. PATENT DOCUMENTS

| | | | |
|---|---|---|---|
| 3,396,016 | 8/1968 | Olson | 96/1.5 |
| 3,624,226 | 11/1971 | Hoover et al. | 96/1.6 |
| 3,953,207 | 4/1976 | Horgan | 96/1.5 |
| 3,963,779 | 6/1976 | Tsukahara | 96/1.5 |
| 3,997,342 | 12/1976 | Bailey | 96/1.6 |

*Primary Examiner*—David Klein
*Assistant Examiner*—John L. Goodrow
*Attorney, Agent, or Firm*—J. J. Ralabate; J. P. O'Sullivan; R. L. Lyons

[57] ABSTRACT

An imaging member comprising a first layer of electrically active charge transport material contained on a supporting substrate, a photoconductive layer overlying said active layer, and a second layer of electrically active charge transport material overlying said photoconductive layer, said photoconductive layer exhibiting the capability of photogeneration of charge carriers and injection of said charge carriers, one of said electrically active layers which comprises an electrically inactive resinous material made electrically active by the addition of certain activating compounds thereto exhibits the capability of facile hole injection and transport and the other electrically active layer exhibits the capability of facile electron injection and transport.

32 Claims, 2 Drawing Figures

COMPOSITE LAYERED PHOTORECEPTOR

BACKGROUND OF THE INVENTION

This invention relates in general to xerography and more specifically to a novel photosensitive device and method of use.

In the art of xerography, a xerographic plate containing a photoconductive insulating layer is imaged by first uniformly electrostatically charging its surface. The plate is then exposed to a pattern of activating electromagnetic radiation, such as light, which selectively dissipates the charge in the illuminated areas of the photoconductive insulator while leaving behind a latent electrostatic image in the non-illuminated areas. This latent electrostatic image may then be developed to form a visible image by depositing finely divided electroscopic marking particles on the surface of the photoconductive layer.

The photoconductive layer used in xerography may comprise a homogeneous layer of a single material such as vitreous selenium or polyvinyl carbazole sensitized with 2,4,7-trinitro-9-fluorenone (TNF); or it may be a composite layer of two or more phases in which a photoconductor is combined with another material. One example of a composite structure comprises a binder layer of finely divided photoconductive particles dispersed in a film-forming electrically insulating organic resin binder. In some cases, a photoconductive material is substituted for the resin binder.

When exposed to imaging light, charge transport in homogeneous photoconductive layers is accomplished by the charge being transported through the bulk of the photoconductive layer such as in the case of vitreous selenium and other homogeneous photoconductive layers. In photoconductive binder layers, charge transport is accomplished through the use of high photoconductor loadings allowing for particle-to-particle contact within the resin binder layer. In the case where photoconductive particles are dispersed in a photoconductive matrix, photoconductivity occurs through the generation of charge carriers in both the photoconductive matrix and the photoconductive pigment particles.

The above photoconductive layers suffer from one common deficiency in that the photoconductive surface during operation is exposed to the surrounding environment, and particularly in the case of cycling xerography, are susceptible to abrasion, chemical attack, heat and multiple exposures to light during cycling. These effects are characterized by a gradual deterioration of the electrical charactersitics of the photoconductive layer resulting in the printing out of surface defects and scratches, localized areas of persistent conductivity which fail to retain an electrostatic charge, and high dark discharge.

In addition to the problems noted above, these photoconductive layers require that the photoconductor comprise either 100 percent of the layer, as in the case of a vitreous selenium layer, or that they preferably contain a high proportion of photoconductive material in the form of pigment in the binder configuration. The requirement that the photoconductive layer contain all or a major portion of a photoconductive material further restricts the physical characteristics of the final photoreceptor member in that the physical characteristics, such as flexibility and adhesion of the photoconductive layer to the supporting substrate, are primarily dictated by the physical properties of the photoconductor, and not by the resin or matrix material which is usually present in a minor amount.

In order to overcome the above deficiencies of the prior art, U.S. patent application Ser. No. 371,647, filed June 20, 1973 and U.S. Pat. No. 3,928,034 were filed, directed to a composite layered configuration in which a photoconductive or photogenerating layer contained on a conductive substrate is overlayed with an electrically active organic overlayed material which effectively seals the photogenerating or photoconductive layer from ambient conditions. These structures are limited to transparent electrically active organic overlayers when used in conjunction with an opaque substrate. U.S. Pat. No. 3,573,906 discloses another composite imaging device which in one embodiment defines a structure which includes an active layer of PVK contained on a substrate with a thin layer of vitreous selenium as the top layer. With the selenium on top, this device fails to provide adequate mechanical properties, such as resistance to abrasion during repetitive use.

Applicant has filed an application which has issued into U.S. Pat. No. 3,953,207 on Apr. 27, 1976, which comprises a first layer of electrically active charge transport material contained on a supporting substrate, a photoconductive layer overlying the active layer, and a second layer of electrically active charge transport material overlying said photoconductive layer.

The instant invention by the same inventor utilizes electrically inactive charge transport material which is made electrically active by the addition of certain activating compounds hereafter disclosed.

OBJECTS OF THE INVENTION

It is, therefore, an object of this invention to provide a novel photosensitive device capable for use in cyclic imaging.

It is another object of this invention to provide a novel photosensitive layered device.

It is another object os this invention to provide a novel photosensitive device which is capable of exhibiting outstanding mechanical properties.

It is a further object of this invention to provide a photosensitive member which exhibits efficient hole and electron photogeneration and transport.

SUMMARY OF THE INVENTION

The present invention is directed to a three-layered composite photoreceptor device. The device comprises a photogenerator or photoconductive layer sandwiched between two electrically active layers. In one embodiment, the photoconductive layer is sandwiched or laminated between a positive or hole transport layer on one side and an electron or negative transport layer on the other side.

The positive or hole transport layer comprises an electrically inactive polymeric material which contains the after-mentioned compounds in order to allow the electrically inactive polymeric material to become electrically active.

"Electrically active" means that the material is capable of supporting the injection of photogenerated charge carriers from the generating material and is capable of allowing the transport of these charge carriers through the active layer in order to discharge a surface charge on the active layer.

"Electrically inactive" means that the material is not capable of supporting the injection of photogenerated charge carriers from the generating material and is not capable of allowing the transport of these charge carries through the material.

This device offers the advantage in that any photogenerating layer may be used in that the photogenerating layer is completely shielded on both sides from abrasion and ambient conditions. The device also removes adhesion constraints from the generator layer in that the generator layer is not in contact with the substrate. Further, the structure may be charged either positively or negatively depending upon whether the top layer is an electron or hole transport layer.

In one embodiment of the present invention, an amorphous or trigonal selenium photogenerating layer is sandwiched between an electron transporting material such as a complex of PVK/TNF alone; and a layer of hole transport material. When TNF is used, it is preferably blended with an inactive polymeric material in order to enhance the mechanical properties of the layer. This configuration is suitable for use in xerographic imaging with positive charging. If the position of the transport layers are reversed, the device then becomes suitable for use with negative charging.

The following compounds may be added to the electrically inactive polymeric material, i.e. material which is incapable of supporting the injection of photogenerated holes from the generating material and incapable of allowing the transport of these holes therethrough in order to make the electrically inactive polymeric material electrically active, i.e. capable of supporting the injection of photogenerated holes from the generating material and capable of allowing the transport of these holes through the active layer in order to discharge a surface charge on the active layer.

One of the activating compounds useful as an additive to the electrically inactive polymeric material making it electrically active is N,N'-diphenyl-N,N'-bis(phenylmethyl)-[1,1'-biphenyl]-4,4'-diamine with the following formula:

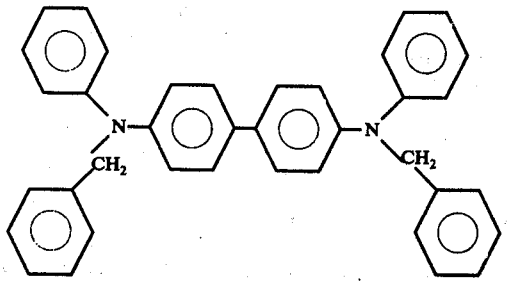

It was found that N,N'-diphenyl-N,N'-bis(phenylmethyl)-[1,1'-biphenyl]-4,4'-diamine dispersed in an organic binder transports charge very efficiently without any trapping when this layer is used contiguous a generation layer and subjected to charge light discharge cycles in an electrophotographic mode. There is no buildup of the residual potential over many thousands of cycles.

Furthermore, when N,N'-diphenyl-N,N'-bis(phenylmethyl)-[1,1'-biphenyl]-4,4'-diamine dispersed in a binder is used as a transport layer contiguous a charge generation layer, there is no interfacial trapping of the charge photogenerated in and injected from the generating layer. No deterioration in charge transport was observed when these transport layers containing N,N'-diphenyl-N,N'-bis(phenylmethyl)-[1,1'-biphenyl]-4,4'-diamine dispersed in a binder were subjected to ultraviolet radiation.

Furthermore, the transport layers comprising N,N'-diphenyl-N,N'-bis(phenylmethyl)-[1,1'-biphenyl]-4,4'-diamine dispersed in a binder were found to have sufficiently high $T_g$ temperatures even at high loadings, thereby eliminating the problems associated with low $T_g$ temperatures as discussed above.

Another compound useful as an additive to the electrically inactive polymeric material making it electrically active is:

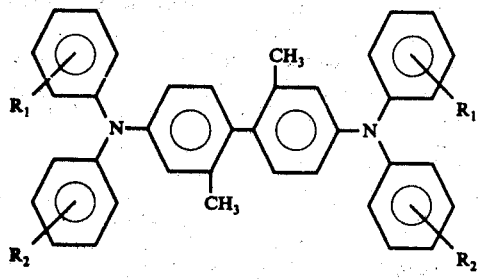

wherein $R_1$ is selected from the group consisting of hydrogen, (ortho) $CH_3$, (metal) $CH_3$, or (para) $CH_3$; and $R_2$ is selected from the group consisting of (ortho) $CH_3$, (meta) $CH_3$ and (para) $CH_3$.

The preferred materials are N,N'-diphenyl-N,N'-bis-(2-methylphenyl)-[2,2'-dimethyl-1,1'-biphenyl]-4,4'-diamine; N,N'-diphenyl-N,N'-bis(3-methylphenyl)-[2,2'-dimethyl-1,1'-biphenyl]-4,4'-diamine; N,N'-diphenyl-N,N'-bis(4-methylphenyl)-[2,2'-dimethyl-1,1'-biphenyl]-4,4'-diamine; N,N,N',N'-tetra(2-methylphenyl)-[2,2'-dimethyl-1,1'-biphenyl]-4,4'-diamine; N,N'-bis(2-methylphenyl)-N,N'-bis(3-methylphenyl)-[2,2'-dimethyl-1,1'-biphenyl]-4,4'-diamine; N,N'-bis(2-methylphenyl)-N,N'-bis(4-methylphenyl)-[2,2'-dimethyl-1,1'-biphenyl]-4,4'-diamine; N,N'-bis(3-methylphenyl)-N,N'-bis(2-methylphenyl)-[2,2'-dimethyl-1,1'-biphenyl]-4,4'-diamine; N,N,N',N'-tetra(3-methylphenyl)-[2,2'-dimethyl-1,1'-biphenyl]-4,4'-diamine; N,N'-bis(3-methylphenyl)-N,N'-bis(4-methylphenyl)-[2,2'-dimethyl-1,1'-biphenyl]-4,4'-diamine; N,N'-bis(4-methylphenyl)-N,N'-bis(2-methylphenyl)-[2,2'-dimethyl-1,1'-biphenyl]-4,4'-diamine; N,N'-bis(4-methylphenyl)-N,N'-bis(3-methylphenyl)-[2,2'-dimethyl-1,1'-biphenyl]-4,4'-diamine and N,N,N',N'-tetra(4-methylphenyl)-[2,2'-dimethyl-1,1'-biphenyl]-4,4'-diamine.

the most preferred materials are:

N,N,N',N'-Tetraphenyl-[2,2'-dimethyl-1,1'-biphenyl]-4,4'-diamine;

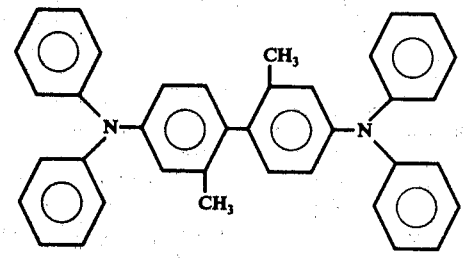

N,N,N',N'-Tetra-(3-methylphenyl)-[2,2'-dimethyl-1,1'-biphenyl]-4,4'-diamine;

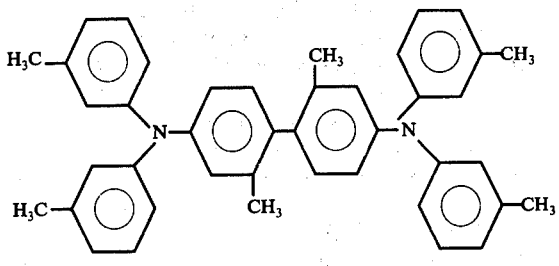

N,N'-Diphenyl-N,N'-bis(3-methylphenyl)-[2,2'-dimethyl-1,1'-biphenyl]-4,4'-diamine:

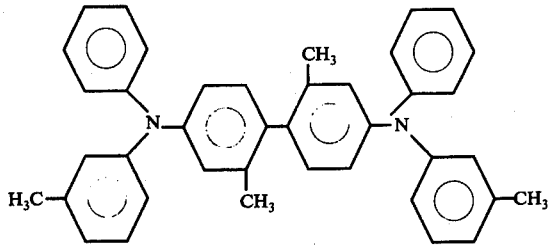

The electrically active layer, i.e. the photogenerated hole transport layer, is substantially non-absorbing to visible light or radiation in the region of intended use, but is "active" in that it allows the injection of photogenerated holes from the photoconductive layer, i.e. charge generation layer, and allows these holes to be transported through the active charge transport layer to selectively discharge a surface charge on the surface of the active layer.

It was found that, unlike the prior art, when the N,N,N',N'-tetraaryl-bitolydiamines of the instant invention were dispersed in an organic binder, this layer transports charge very efficiently without any trapping of charges when this layer is used contiguous to a generator layer and subjected to charge/light discharge cycles in an electrophotographic mode. There is no buildup of the residual potential over many thousands of cycles.

Another compound which may be added to the electrically inactive polymeric material in order to make the material electrically active has the following formula:

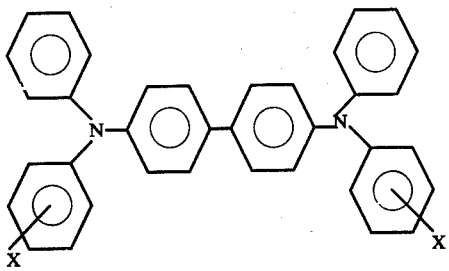

wherein X is selected from the group consisting of (ortho) $CH_3$, (meta) $CH_3$, (para) $CH_3$, (ortho) Cl, (meta) Cl and (para) Cl. The chemical name of the above formula is N,N'-diphenyl-N,N'-bis-(alkylphenyl)-[1,1'-biphenyl]-4,4'-diamine wherein the alkyl is selected from the group consisting of 2 methyl, 3 methyl and 4 methyl or the compound may be N,N'-diphenyl-N,N'-bis(halo phenyl)-[1,1'-biphenyl]-4,4'-diamino wherein the halo is selected from the group consisting of 2-chloro, 3-chloro and 4-chloro.

The above described small molecules due to their unsymmetrical structure along the N-N axis allows them to be substantially more soluble in resin binders described herein whereas the symmetrical structure along the N-N axis, i.e. tetra substituted or unsubstituted tetra phenyl benzidine, are not sufficiently soluble in the resin binders described herein for the intended purposes.

Furthermore, when the substituted N,N,N',N'-tetraphenyl-[1,1'-biphenyl]-4,4'-diamines of the instant invention dispersed in a binder are used as transport layers contiguous a charge generation layer, there is no interfacial trapping of the charge photogenerated in and injected from the generating layer. When subjected to ultraviolet radiation, no deterioration in charge transport was observed in these transport layers containing the substituted N,N,N',N'-tetraphenyl-[1,1'-biphenyl]-4,4'-diamines of the instant invention.

Furthermore, the transport layers comprising substituted N,N,N',N'-tetraphenyl-[1,1'-biphenyl]-4,4'-diamines of the instant invention dispersed in a binder were found to have sufficiently high ($T_g$) even at high loadings, thereby eliminating the problems associated with low ($T_g$) as discussed above.

Another compound which may be added to the electrically inactive polymeric material to make it electrically active is bis(4-diethylamino-2-methylphenyl)-phenylmethane. The formula of bis(4-diethylamino-2-methylphenyl)phenylmethane is as follows:

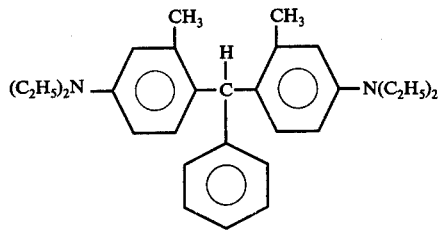

In all of the above charge transport layers, the compound which makes the electrically inactive polymeric material electrically active should be present in amounts of from about 15 to about 75 percent by weight.

DETAILED DESCRIPTION OF THE INVENTION

Figure 1:
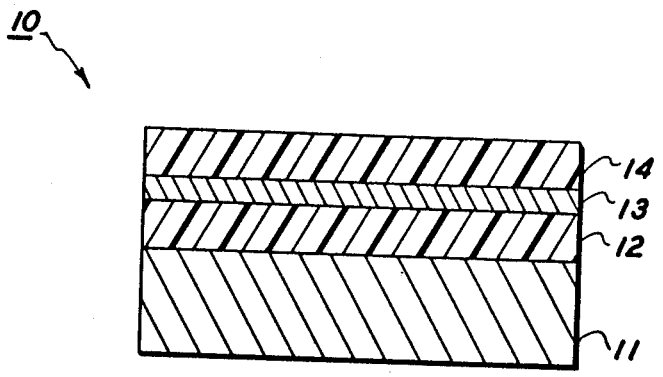
FIG. 1 is a schematic illustration of one embodiment of an imaging member of the present invention.

The imaging member of the instant invention comprises a first layer of electrically active charge transport material contained on a supporting substrate, a photoconductive layer overlying the active layer, and a second layer of electrically active charge transport material overlying said photoconductive layer, one of the electrically active layers which comprises an electrically inactive resinous material made electrically active by the addition of certain activating compounds exhibits the capability of facile hole injection and transport and the other electrically active layer exhibits the capability of facile electron injection and transport.

As defined herein, a photoconductor is a material which is electrically photoresponsive to light in the wavelength region in which it is to be used. More specifically, it is a material whose electrical conductivity increases significantly in response to the absorption of electromagnetic radiation in the wavelength region in which it is to be used. This definition is necessitated by the fact that a vast number of organic compounds are known or expected to be photoconductive when irradiated with strongly absorbed ultraviolet, X-ray or gamma radiation. Photoconducitivity in organic materials is a common phenomenon. Practically all highly conjugated organic compounds exhibit some degree of photoconductivity under appropriate conditions. Many of these organic materials have their prime wavelength response in the ultraviolet. However, little commercial utility has been found for ultraviolet responsive materials, and their short wavelength response is not particularly suitable for document copying or color reproduction. In view of the general prevalence of photoconductivity in organic compounds following short wavelength excitation, it is therefore necessary that for the instant invention the term "photoconductor" or "photoconductive" be understood to include only those materials which are in fact photoresponsive in the wavelength region in which they are to be used.

"Electrically active" as it pertains to the photogenerated hole transport layer, means that the material is capable of supporting the injection of photogenerated holes or positive charge carriers from the generating material and is capable of allowing the transport of these holes through the active layer in order to discharge a surface charge on the active layer.

"Electrically active" as it pertains to the photogenerated electron transport layer, means that the material is capable of supporting the injection of photogenerated electrons or negative charge carriers from the generating material and is capable of allowing the transport of these electrons through the active layer in order to discharge a surface charge on the active layer.

"Electrically inactive" as it pertains to the resinous material used in the photogenerated hole transport layer, means that this electrically inactive material is not capable of supporting the injection of photogenerated holes from the generating material and is not capable of allowing the transport of these charge carriers through the material.

The active material, which is also referred to as the active matrix material when used as a matrix for a binder layer, is a substantially non-photoconductive material which supports an injection efficiency of photogenerated holes from the photoconductive layer of at least about 10 percent at fields of about $2 \times 10^5$ volts/cm. This material is further characterized by the ability to transport the carrier at least $10^{-3}$ cm. at a field of no more than about $10^6$ volts/cm. In addition, the active material is substantially transparent in the wavelength region in which the device is to be used.

The active transport material which is employed in conjunction with the photoconductive layer of the present invention is a material which is an insulator to the extent that an electrostatic charge placed on said active binder material is not conducted in the absence of illumination at a rate sufficient to prevent the formation and retention of an electrostatic latent image thereon. In general, this means that the specific resistivity of the active transport material should be at least about $10^{10}$ ohms/cm.

As can be seen from the above discussion, most materials which are useful for active layers of the instant invention are incidentally also photoconductive when radiation of wavelengths suitable for electronic excitation is absorbed by them. However, photoresponse in the short wavelength region, which falls outside the spectral region for which the photoconductor is to be used, is irrelevant to the performance of the device. It is well known that radiation must be absorbed in order to excite photoconductive response, and the transparency criteria stated above for the active materials implies that these materials do not contribute significantly to the photoresponse of the photoreceptor in the wavelength region of use.

The reason for the requirement that the active materials must be transparent is based upon the discovery that under all practical conditions, the efficiency of photoinjection from the photoconductor into the active material for visible radiation absorbed by the photoconductor far exceeds the intrinsic photosensitivity of the active material in any wavelength region visible or otherwise.

It is not the intent of this invention to restrict the choice of active materials to those which are transparent in the entire visible region. For example, with a thin non-transparent electrically active organic overlayer, imagewise exposure may be accomplished in the normal manner. With a thicker active layer and a transparent substrate, imagewise exposure may be accomplished through the substrate without the light having to pass through a top layer of an active material. In this case, the active material need not be non-absorbing in the wavelength region of use. Other applications where complete transparency is not required for the active material in the visible region include the selective recording of narrow-band radiation such as the emitted from lasers, spectral pattern recognition, and possible functional color xerography such as color coded form duplication.

DETAILED DESCRIPTION OF THE DRAWINGS

Referring to FIG. 1, reference character 10 designates an imaging member in the form of a plate which comprises a supporting substrate 11 having a layer of organic charge transport layer 12 thereon, a photoconductive layer 13 overlays transport layer 12, and a second organic charge transport layer 14 overlays photoconductive layer 13.

Substrate 11 is preferably made up of any suitable conductive material. Typical conductors comprise aluminum, stainless steel, nickel, brass or the like. The substrate may be rigid or flexible and of any convenient thickness. Typical substrates include endless flexible belts or sleeves, sheets, webs, plates, cylinders, and dryms. The substrate or support may also comprise a composite structure such as a thin conductive coating contained on a paper base; a plastic coated with a thin conductive layer such as aluminum or copper iodide; or glass coated with a thin conductive coating of chromium or tin oxide. In some cases, the substrate may be dispensed with entirely and the imaging member made up of only the three top layers. In this case, the imaging member may be placed upon a conductive platen during the charging and exposure steps or optionally charged on either side with two corona charging devices to opposite polarities.

In one embodiment of the present invention, electrically active layer 12 may comprise any electrically inactive resinous material which contains a sufficient amount of electrically activating compounds hereafter described so that the resinous material is now capable of supporting the injection of photogenerated holes from the photoconductive layer 13 which is capable of exhibiting the capability of photogeneration of photogenerated holes and injection of these holes into and through electrically active layer 12 to selectively discharge a charge of opposite polarity at the substrate interface or at the surface of the member.

Electrically active layer 12 not only serves to transport photogenerated holes, but also protects photoconductive layer 13 from unwanted charge injection from substrate 11. In general, the thickness of electrically active layer 12 should be from about 1 to 100 microns, but thicknesses outside this range can also be used.

"Activating compounds" means a compound when added to the electrically inactive resinous materials of the instant invention make these electrically inactive resinous materials electrically active, i.e. capable of facile hole injection and transport.

The preferred embodiments of this invention comprise active layer 12 as an electrically active layer which comprises an electrically inactive resinous material made electrically active by the addition of certain activating compounds added thereto which comprise:

(1) N,N'-diphenyl-N,N'-bis(phenylmethyl)-[1,1'-biphneyl]-4,4'-diamine with the following formula:

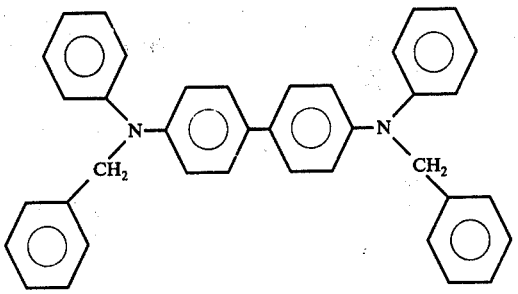

It was found that N,N'-diphenyl-N,N'-bis(phenylmethyl)-[1,1'-biphenyl]-4,4'-diamine dispersed in an organic binder transports charge very efficiently without any trapping when this layer is used contiguous a generation layer, i.e. photoconductive layer, and subjected to charge light discharge cycles in an electrophotographic mode. There is no buildup of the residual potential over many thousands of cycles.

Furthermore, when N,N'-diphenyl-N,N'-bis(phenylmethyl)-[1,1'-biphenyl]-4,4'-diamine dispersed in a binder is used as a transport layer contiguous a charge generation layer, i.e. photoconductive layer, there is no interfacial trapping of the charge photogenerated in and injected from the generating layer. No deterioration in charge transport was observed when these transport layers containing N,N'-diphenyl-N,N'-bis(phenylmethyl)-[1,1'-biphenyl]-4,4'-diamine dispersed in a binder subjected to ultraviolet radiation.

(2) Another activating compound useful as an additive to the electrically inactive polymeric material making it electrically active is:

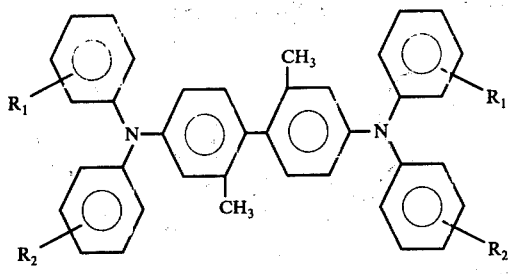

wherein $R_1$ is selected from the group consisting of hydrogen, (ortho) $CH_3$, (meta) $CH_3$ or (para) $CH_3$, and $R_2$ is selected from the group consisting of (ortho) $CH_3$, (meta) $CH_3$ and (para) $CH_3$.

The preferred materials are N,N'-diphenyl-N,N'-bis-(2-methylphenyl)-[2,2'-dimethyl-1,1'-biphenyl]-4,4'-diamine; N,N'-diphenyl-N,N'-bis(3-methylphenyl)-[2,2'-dimethyl-1,1'-biphenyl]-4,4'-diamine; N,N'-diphenyl-N,N'-bis(4-methylphenyl)-[2,2'-dimethyl-1,1'-biphenyl]-4,4'-diamine; N,N,N',N'-tetra(2-methylphenyl)-[2,2'-dimethyl-1,1'-biphenyl]-4,4'-diamine; N,N'-bis(2-methylphenyl)-N,N'-bis(3-methylphenyl)-[2,2'-dimethyl-1,1'-biphenyl]-4,4'-diamine; N,N'-bis(2-methylphenyl)-N,N'-bis(4-methylphenyl)-[2,2'-dimethyl-1,1'-biphenyl]-4,4'-diamine; N,N'-bis(3-methylphenyl)-N,N'-bis(2-methylphenyl)-[2,2'-dimethyl-1,1'-biphenyl]-4,4'-diamine; N,N,N',N'-tetra(3-methylphenyl)-[2,2'-dimethyl-1,1'-biphenyl]-4,4'-diamine; N,N'-bis(3-methyl-phenyl)-N,N'-bis(4-methylphenyl)-[2,2'-dimethyl-1,1'-biphenyl]-4,4'-diamine; N,N'-bis(4-methylphenyl)-N,N'-bis(2-methylphenyl)-[2,2'-dimethyl-1,1'-biphenyl]-4,4'-diamine; N,N'-bis(4-methylphenyl)-N,N'-bis(3-methylphenyl)-[2,2'-dimethyl-1,1'-biphenyl]-4,4'-diamine and N,N,N',N'-tetra(4-methylphenyl)-[2,2'-dimethyl-1,1'-biphenyl]-4,4'-diamine.

The most preferred materials are N,N,N',N'-Tetraphenyl-[2,2'-dimethyl-1,1'-biphenyl]-4,4'-diamine;

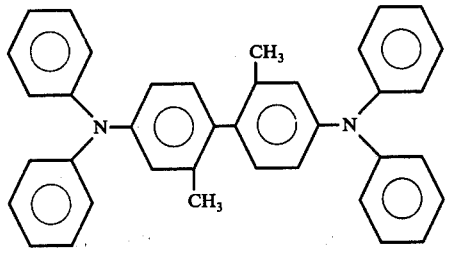

N,N,N',N'-Tetra-(3-methylphenyl)-[2,2'-dimethyl-1,1'-biphenyl]-4,4'-diamine:

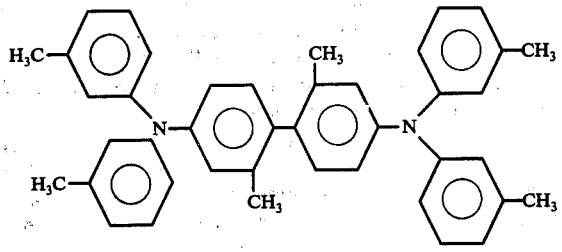

N,N'-Diphenyl-N,N'-bis(3-methylphenyl)-[2,2'-dimethyl-1,1'-biphenyl]-4,4'-diamine:

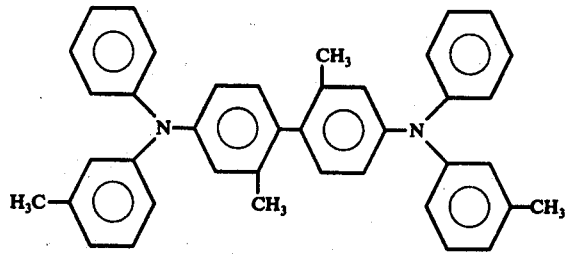

The electrically active layer, i.e., the photogenerated hole transport layer, is substantially non-absorbing to visible light or radiation in the region of intended use, but is "active" in that it allows the injection of photogenerated holes from the photoconductive layer, i.e. charge generation layer, and allows these photogenerated holes to be transported through the electrically active charge transport layer to selectively discharge a surface charge on the surface of the active layer or at the interface between the substrate and the transport layer.

It was found that, unlike the prior art, when the N,N,N',N'-tetraaryl-bitolyldiamines of the instant invention were dispersed in an organic binder this layer transports charge very efficiently without any trapping of charges when this layer is used contiguous to a generator layer and subjected to charge/light discharge cycles in an electrophotographic mode. There is no buildup of the residual potential over many thousands of cycles.

(3) Another activating compound which may be added to the electrically inactive polymeric material in order to make the material electrically active is as follows:

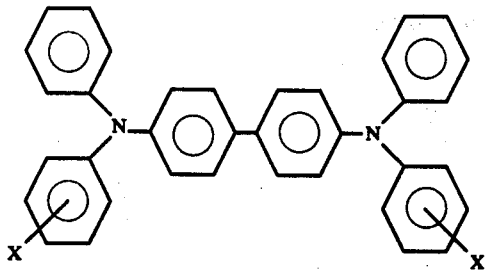

wherein X is selected from the group consisting of (ortho) $CH_3$, (meta) $CH_3$, (para) $CH_3$, (ortho) Cl, (meta) Cl and (para) Cl. The chemical name of the above formula is N,N'-diphenyl-N,N'-bis-(alkylphenyl)-[1,1'-biphenyl]-4,4'-diamine wherein the alkyl is selected from the group consisting of 2-methyl, 3-methyl and 4-methyl or the compound may be N,N'-diphenyl-N,N'-bis(halo phenyl)[1,1'-biphenyl]-4,4'-diamino wherein the halo is selected from the group consisting of 2-chloro, 3-chloro and 4-chloro.

The above-described small molecules due to their unsymmetrical structure along the N-N axis allows them to be substantially more soluble in resin binders described herein whereas the symmetrical structure along the N-N axis, i.e. tetra substituted or unsubstituted tetra phenyl benzidine, are not sufficiently soluble in the resin binders described herein for the intended purposes.

Furthermore, when the substituted N,N,N',N'-tetraphenyl[1,1'-biphenyl]-4,4'-diamines of the instant invention dispersed in a binder are used as transport layers contiguous a charge generation layer, there is no interfacial trapping of the charge photogenerated in and injected from the generating layer. When subjected to ultraviolet radiation, no deterioration in charge transport was observed in these transport layers containing the substituted N,N,N',N'-tetraphenyl-[1,1'-biphenyl]-4,4'-diamines of the instant invention.

Furthermore, the transport layers comprising substituted N,N,N',N'-tetraphenyl-[1,1'-biphenyl]-4,4'-diamines of the instant invention dispersed in a binder were found to have sufficiently high ($T_g$) even at high loadings, thereby eliminating the problems associated with low ($T_g$) as discussed above.

(4) Another activating compound which may be added to the electrically inactive polymeric material to make it electrically active is bis-(4-diethylamino-2-methylphenyl)-phenylmethane which has the formula:

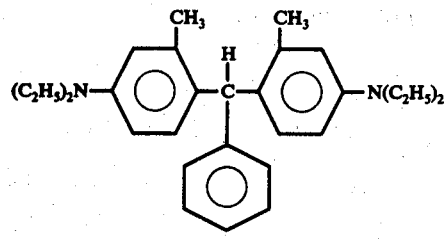

In all of the above charge transport layers, the activating compound which makes the electrically inactive polymeric material electrically active should be present in amounts of from about 15 to about 75 percent by weight, preferably from about 25 to 50 percent by weight.

Active layer 12 may comprise any transport electrically inactive resinous material such as those described in Middleton et al, U.S. Pat. No. 3,121,006, the entire content of which is hereby incorporated herein by reference.

The preferred electrically inactive resinous materials are polycarbonate resins. The preferred polycarbonate resins have a molecular weight ($M_w$) from about 20,000 to about 100,000, more preferably from about 50,000 to about 100,000.

The materials most preferred as the electrically inactive resinous material is poly(4,4'-isopropylidene-diphenylene carbonate) with a molecule weight ($M_w$) of from about 35,000 to about 40,000, available as Lexan 145 from General Electric Company; poly(4,4'-isopropylidene-diphenylene carbonate) with a molecular weight ($M_w$) of from about 40,000 to about 45,000, available as Lexan 141 from the General Electric Company; a polycarbonate resin having a molecule weight ($M_w$) of from about 50,000 to about 100,000, available as Makrolon from Farbenfabricken Bayer A.G. and a polycarbonate resin having a molecular weight ($M_w$) of from about 20,000 to about 50,000, available as Merlon from Mobay Chemical Company.

Alternatively, active layer 12 may comprise a photogenerated electron transport material of the type described for layer 14. In this instance, layer 14 would then normally consist of a photogenerated hole transport material, such as those listed as suitable materials for layer 12.

Photoconductive layer 13 may comprise any suitable inorganic or organic material or mixtures thereof. The layer may comprise any suitable structure known to the art such as a substantially homogeneous layer of photoconductive material or any suitable composite structure such as a binder configuration in which finely divided photoconductive particles are dispersed in a binder matrix material.

When using a binder configuration, photoconductive particles are dispersed randomly without orientation in a matrix material. The photoconductive particles may consist of any suitable inorganic or organic photoconductor and mixtures thereof. Inorganic materials include inorganic crystalline compounds such as cadmium sulfoselenide, cadmium selenide, cadmium sulfide, and mixtures thereof. Typical inorganic photoconductive glasses include amorphous selenium, and selenium alloys such as selenium-tellurium, selenium-arsenic and selenium-tellurium-arsenic. Selenium may also be used in a crystalline form known as trigonal selenium. Typical organic photoconductive materials include phthalocyanine described in U.S. Pat. No. 3,357,989 to Byrene et al. The above list of photoconductors should in no way be taken as limiting, but is merely illustrative of suitable materials.

The binder material may comprise any suitable film forming organic resin, an electrically active organic material, or a photoconductive material.

In another embodiment of the instant invention, the binder structure is modified to insure that the photoconductive particles are in the form of continuous chains through the thickness of the binder layer. This type of photoconductive layer is more fully described in U.S. Pat. No. 3,787,208, which is incorporated herein by reference.

Alternatively, the photoconductive layer may consist entirely of a substantially homogeneous photoconductive material such as a layer of amorphous selenium, a selenium alloy such as selenium-tellurium, selenium-arsenic and selenium-tellurium-arsenic, trigonal selenium or a powdered or sintered photoconductive layer such as a cadmium sulfoselenide or phthalocyanine.

The thickness of the photoconductive layer is generally not critical. Layer thicknesses of from about 0.05 to 20 microns have been found satisfactory, with a preferred thickness of about 0.2 to 5 microns exhibiting good results. When using trigonal selenium alone, however, it is preferred that the layer thickness be maintained in a range of about 0.03–0.8 in order to avoid a degradation in the electrical characteristics. However, binder layers using trigonal selenium may be much thicker.

Reference character 14 comprises an electrically active transport material layer which overlays the photoconductive layer 13. In one embodiment of the invention, active transport layer 14 comprises a photogenerated electron transport material which is capable of both supporting electron injection from the photoconductive layer and transporting said photogenerated electrons under the influence of an applied field. In order to function in the manner outlined above for one embodiment of the invention, the active transport material should be substantially transparent to the particular wavelength region used for xerographic copying. In particular, the active transport material should be substantially non-absorbing in at least a significant portion that part of the electromagnetic spectrum which ranges from about 4200 to 8000 Angstroms because most xerographically useful photoconductors have photoresponse to wavelengths in this region.

As mentioned above, the active transport layer 14 comprises aromatic or heterocyclic electron acceptor materials which have been found to exhibit negative charge carrier transport properties as well as the requisite transparency characteristics. Typical electron acceptor materials included within the scope of the instant invention include phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrophenyl, 2,4,6-trinitroanisole, trichlorotrinitrobenzene, trinitro-O-toulene, 4,6-dichloro-1,3-dinitrobenzene, 4,6-dibromo-1,3-dinitrobenzene, P-dinitrobenze, chloranil, bromanil, and mixtures thereof. It is further intended to include within the scope of those materials suitable for use in active transport layer 14, other reasonable structural or chemical modifications of the above-described materials provided that the modified compound exhibits the desired charge carrier transport characteristics.

While any and all aromatic or heterocyclic electron acceptors having the requisite transparency characteristic are within the purview of the instant invention, particularly good electron transport properties are found with aromatic or heterocyclic compounds having more than one substituent of the strong electron withdrawing substituents such as nitro—($NO_2$), sulfonate ion (—$SO_3$), carboxyl (—COOH) and cyano—(CH) groupings. From this class of materials 2,4,7-trinitro-9-fluorenone (TNF), 2,4,5,7-tetranitrofluorenone, trinitroanthracene, dinitroacridene, tetracyanopyrene, and dinitroanthraquinone are preferred materials because of their availability and superior electron transport properties.

It will be obvious to those skilled in the art that the use of any polymer having the described aromatic or heterocyclic electron acceptor moiety as an integral portion of the polymer structure will function as an active transport material. It is not the intent of the invention to restrict the type of polymer which can be employed as the transport material, provided it has an active electron acceptor moiety to provide the polymer with electron transport characteristics. Polyesters, polysiloxanes, polyamides, polyurethanes and epoxies, as well as block, random or graft copolymers containing the aromatic moiety are therefore exemplary of the various types of polymers which could be employed. In addition, electronically inactive polymers in which the active electron acceptor or material is dispersed at high concentration can be employed as hereinafter described.

In another embodiment of the present invention, layers 14 may each comprise an active material capable of transporting both holes and electrons. One material which is suitable for this embodiment comprises a complex of PVK and TNF. A satisfactory concentration for the TNF is about 1 to 15 weight percent, with the balance comprising PVK.

The substantial or significant transparency of the active transport material within the context of the instant invention, as exemplified by FIG. 1, means that a sufficient amount of radiation from a source must pass through the active transport layer 14 in order that the photoconductive layer 13 can function in its capacity as a photogenerator and injector of electrons. More specifically, substantial transparency is present in the active transport materials of the present invention when the active transport material is non-photoconductive and non-absorbing in at least some significant portion of the wavelength region of from about 4200 to 8000 Angstrom Units. This property of substantial transparency enables enough activating radiation to impinge the photoconductor layer so as to cause discharge of the charged active transport photoreceptor of the present invention.

It is not the intent of this invention to strictly restrict the choice of active transport materials to those which are transparent in the entire visible region. For example, with a thin, non-transparent electrically active organic overlayer material, imagewise exposure may be accomplished in the normal manner. With a thicker active layer, and a transparent substrate, and substantially transparent active layer 12, imagewise exposure may be accomplished through the substrate without the light passing through the layer of active transport material. In this case, the active material need not be non-absorbing in the wavelength region of use. This particular application takes advantage of the injection and transport properties of the present active materials and falls within the purview of the instant invention. Other applications where complete transparency is not required for the active material include the selective recording of narrow-band radiation such as that emitted from lasers, spectral pattern recognition, color coded form duplication, and possibly color xerography.

While the active material layer 14 of FIG. 1 may consist exclusively of charge transport material, for purposes of the present invention, the layer may also comprise the charge transport material at a sufficient concentration in a suitable electronically inert binder material to effect particle-to-particle contact or to effect sufficient proximity thereby permitting effective charge transport from the photo-injecting pigments of the instant invention through the layer. Generally, there must be a volume ratio of at least 25 percent active transport material to electronically inert binder material to obtain the desired particle-to-particle contact or proximity. Since one of the active matrix layers may be made somewhat thin, while the other is made correspondingly thicker, the capacitive split, and hence electric field experienced by each layer will enable progressively less transport material in the inert binder for satisfactory transport properties. Typical resin binder materials for the practice of the invention are polystyrene; silicone resins such as DC-801, DC-804 and DC-997 all manufactured by the Dow Corning Corporation; and Lexan, a polycarbonate resin, SR-82 manufactured by the General Electric Company; acrylic and methacrylic ester polymers such as Acryloid A10 and Acryloid B-72, polymerized ester derivatives of acrylic and alpha-acrylic acids both supplied by Rohm and Haas Company and Lucite 44, Lucite 45 and Lucite 46 polymerized butyl methacrylates supplied by the E. I. du-Pont de Nemours & Company; chlorinated rubber such as Parlson supplied by the Hercules Powder Company; vinyl polymers and copolymers such as polyvinyl chloride, polyvinyl acetate, etc. including Vinylite VYHH and VMCH manufactured by the Bakelite Corporation; cellulose esters and ethers such as ethyl cellulose, nitrocellulose, etc.; alkyd resins such as Glyptal 2469 manufactured by the General Electric Company, etc.; and polyester resins such as those available from Goodyear under the tradename Flexclad. In addition, mixtures of such resins with each other or with plasticizers so as to improve adhesion, flexibility, blocking, etc. of the coatings may be used. Thus, Rezyl 869 (a linseed oilglycerol alkyd manufactured by American Cyanamid Company) may be added to chlorinated rubber to improve its adhesion and flexibility. Similarly, Vinylites VYHH and VMCH (polyvinyl chloride-acetate copolymers manufactured by the Bakelite Company) may be blended together. Plasticizers include phthalates, phosphates, adipates, etc. as is well known to those skilled in the art.

The active transport material which is employed in conjunction with the photoconductive layer in the instant invention is a material which is an insulator to the extent that an electrostatic charged placed on said active transport material is not conducted in the absence of illumination at a rate sufficient to prevent the formation and retention of an electrostatic latent image thereon. In general, this means that the specific resistivity of the active transport material should be at least $10^{10}$ ohms-cm. and preferably will be several orders higher. For optimum results, however, it is preferred that this specific resistivity of the active binder layer in the absence of activating illumination or charge injection from an adjacent layer be about $10^{12}$ ohms-cm.

Because the overlayer functions as an active transport layer, thickness is not critical to the function of the xerographic member. However, the thickness of said active transport layer would be dictated by practical needs in terms of the amounts of electrostatic charge necessary to induce an applied field suitable to effect electron injection and transport. Therefore, the thicknesses of layers 12 and 14 may be varied at will to obtain the desired electric fields for the most efficient charge transport in both active matrix materials. Active transport layer thicknesses may vary from about 1 to 100 microns, but thicknesses outside this range may also be used.

In another embodiment of the present invention, the requirements for transparency of both layers is modified to the extent that the active layer through which imaging light is passing should be substantially transparent, but transparency for the layer through which light is not passing is not a requirement. It should also be understood that the thickness of active layers may be varied to any desired degree in order to control the mechanical and electrical properties of the device. In another embodiment of the present invention, the requirement for transparency of both layers is lifted to the extent that the active layer through which imaging light is passing may be made sufficiently thin to allow imagewise. exposure in the normal manner or through a transparent substrate.

As stated above, in an alternative embodiment of the present invention, active layer 14 may comprise a material such as a blend of PVK and TNF which would transport charge carriers of both polarities, i.e. both holes and electrons. In this case, the structure may be charged positive or negative without the requirement of active layer intercharge. The only limiation on this embodiment is that one side of the sandwich be thin enough to allow imagewise exposure in the normal manner or through a transparent substrate.

Figure 2:
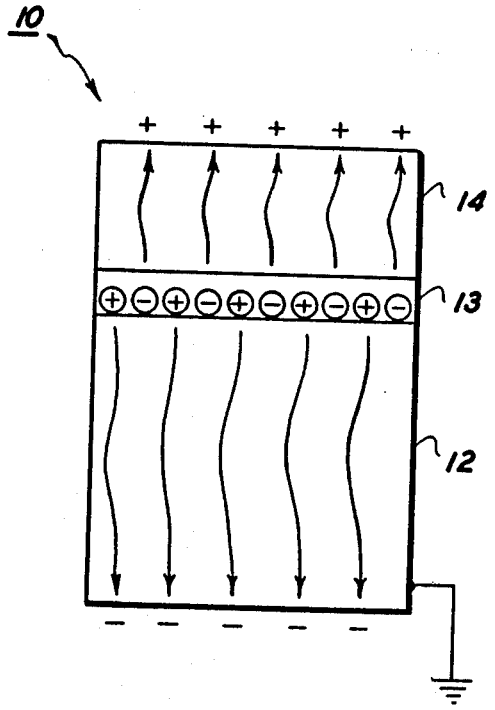
FIG. 2 schematically illustrats the mechanism of charge generation and transport for the embodiment of FIG. 1.

FIG. 2 illustrates schematically, the charge generation and transport mechanism for one embodiment of the present invention. In FIG. 2, imaging radiation to which the top transport layer is transparent, strikes the photoconductive or charge generating layer generating electron hole pairs which are injected into and transported through the adjacent photogenerated hole and photogenerated electron transport layers, respectively. In the embodiment illustrated in FIG. 2, the top transport layer exhibits good photogenerated electron transport while the bottom transport layer exhibits preferred transport for photogenerated holes. This structure, therefore, is charged positively, and upon the generation of charged carriers, the electrons selectively move to the top surface to discharge the electrostatic charge while the holes move through the bottom active layer to neutralize a corresponding balancing negative charge at the substrate interface. In an alternative embodiment, the photogenerated hole transport layer may comprise the top layer and the photogenerated electron transport layer may comprise the bottom layer and in this instance, the photoreceptor member would be charged to a negative polarity and the charge carriers illustrated in FIG. 2 would be reversed.

DESCRIPTION OF THE PREFERRED EMBODIMENTS

The following Examples further specifically define the present invention with respect to a method of making a photosensitive member containing a photoconductive layer sandwiched between two active organic layers. The percentages are by weight unless otherwise indicated. The Examples below are intended to illustrate various preferred embodiments of the instant invention.

EXAMPLE I

Preparation of
N,N'-diphenyl-N,N'-bis(phenylmethyl)-[1,1'-biphenyl-4,4']-diamine Into a 1000 milliliter round bottom three-necked flask fitted with a magnetic stirrer and a dropping funnel which is flushed with argon, is placed 500 milliliters of anhydrous dimethylsulfoxide (DMSO). Then 100.8 grams (1.8 moles) of powdered potassium hydroxide is added to the flask. The mixture is then stirred for 15 minutes. Then 100.8 grams (0.3 moles) of N,N'-diphenyl-[1,1'-biphenyl]-4,4'-diamine is added to the mixture. The mixture is now a deep red heterogeneous mixture. The mixture is then stirred at room temperature for 2 hours. Then 200 grams (1.2 moles) of benzyl bromide is added portionwise to the mixture. The mixture is intermittently cooled in order to maintain the temperature between 20° and 40° C. The mixture is then stirred for 2 hours. The mixture becomes brown in color. The mixture is then poured into 1000 milliliters of benzene. The mixture is then extracted with water 4 times using about 2.5 liters of water each time. The mixture is then dried with magnesium sulfate. The benzene is then evaporated from the mixture leaving a black sludge residue. To this add 1 liter of acetone and heat to reflux for about 10 minutes. Let the mixture cool and filter the red solidfrom the mixture. Then column chromatograph using Woelm neutral alumina, evaporate eluent. Then wash residue with methanol and dry. This yields 90 grams of white crystals of N,N'-diphenyl-N,N'-bis(-phenylmethyl)-[1,1'-biphenyl]-4,4'-diamine with a melting point of from 141° to 142° C. Additional products may be recovered from the column which equals 35 grams. The total yield is 81 percent.

EXAMPLE II

Preparation of
N,N'-diphenyl-N,N'-bis(3-methylphenyl)-[1,1'-biphneyl]-4,4'-diamine In a 5000 milliliter, round bottom, three-necked flask fitted with a mechanical stirrer and blanketed with argon, is place 336 grams (1 mole) of N,N'-diphenylbenzidene, 550 grams (2.5 miles) of m-iodotoluene, 550 grams (4 moles) potassium carbonate (anhydrous) and 50 grams of copper bronze catalyst and 1500 ml dimethylsulfoxide (anhydrous). The heterogeneous mixture is refluxed for 6 days. The mixture is allowed to cool. 2000 ml of benzene is added. The dark slurry is then filtered. The filtrate is extracted 4 times with water. Then the filtrate is dried with magnesium sulfate and filtered. The benzene is taken off under reduced pressure. The black product is column chromatographed using neutral Woelm alumina. Colorless crystals of the product are obtained by recrystallizing the product from n-octane. The melting point is 167° - 169° C. The yield is 360 grams (65%).

EXAMPLE III

Preparation of
N,N'-diphenyl-N,N'-bis(3-methylphenyl)-[2,2'-dimethyl-1,1'-biphenyl]-4,4'-diamine In a 5000 milliliter, round bottom, three-necked flask fitted with a mechanical stirrer and blanketed with argon, is placed 10 grams of di-m-tolyphenylamine, which is prepared from aniline and m-iodotoluene by a technique described by F. D. Hager, Org. Synth., Coll., Vol. 1, 544 (1941), and dissolved in 200 milliliters of glacial acetic acid. This solution is cooled to 15° C. While rapidly stirring, water is added dropwise until a slurry forms. 20 grams of ceric ammonium nitrate (ammonium hexanitratocerate IV) is dissolved in 65 milliliters of water to which 85 milliliters of glacial acetic acid is added. This ceric ammonium nitrate solution is then added dropwise, about one drop per second, to the cooled rapidly stirred slurry. After completion of the ceric addition the reaction is stirred for 30 minutes. Then about 0.3 to 0.4 grams of $SnCl_2$ in crystalline form is added to the mixture. The mixture is stirred an additional 15 minutes while the mixture is maintained at 15° C. The slurry is then filtered. The solids collected are washed with water followed by methanol. The materials are dried, dissolved in benzene and chromatographed on a neutral alumina column. The product is eluted with benzene and finally recrystallized from a mixture of 75 parts acetone and 25 parts isopropanol.

EXAMPLE IV

Preparation of
bis(4-diethylamino-2-methylphenyl)-phenylmethane

Into a 100 milliliter round bottom flask fitted with a mechanical stirrer and a dropping funnel is placed 8.85 grams (0.05 moles) of N,N-diethyl-m-toluidine and 3.0 grams (0.03 moles) of benzaldehyde and 10 milliliters of n-butanol containing 0.75 grams of concentrated sulfuric acid. The flask is flushed with nitrogen to remove air and refluxed for 18 hours with a nitrogen atmosphere. The material is then cooled to room temperature. A sufficient amount of sodium bicarbonate is added in order to neutralize the acid. 10 milliliters of methanol is added whereby a yellowish white precipitation is formed. The yellowish white material is filtered out. The material may then be washed with cold methanol in order to remove the yellow color. The material may be recrystallized from either methanol or ethanol. In order to further purify the material, it may be put through a neutral alumina column. The material is eluted with benzene. The first material to be fractionated off of the column is a clear liquid. This liquid is placed in a rotary evaporator and the solvent is removed. The residue is either a clear liquid or a white solid. The material may be recrystallized using methanol or ethanol. White crystals are obtained. A 70 percent yield based upon the benzaldehyde is obtained. The product is vacuum dried in order to remove the remaining solvent.

EXAMPLE V

A photosensitive layered structure similar to that illustrated in FIG. 1 consisting of an aluminized Mylar substrate, having a 22 micron thick layer of a photogenerated hole transport material comprising 50 percent of weight of N,N'-diphenyl-N,N'-bis(phenylmethyl)-[1,1'-biphenyl]-4,4'-diamine as prepared as in Example I and 50 percent by weight of poly(4,4'-isopropylidene-diphenylene carbonate) available from General Electric Company as Lexan 145 over the substrate, a 1 micron layer of amorphous selenium over the photogenerated hole transport material and a 3 micron layer of TNF/polyester as a top layer is prepared by the following technique:

A photogenerated hole transport layer is prepared by dissolving in 135 grams of methylene chloride, 10 grams of N,N'-diphenyl-N,N'-bis(phenylmethyl)-[1,1'-biphenyl]-4,4'-diamine as prepared in Example I and 10 grams of poly(4,4'-isopropylidene-diphenylene carbonate) available from General Electric Company as Lexan 145. The solution is mixed to form a homogeneous dispersion. A layer of the above mixture is applied to an aluminized Mylar substrate by applying the solution of material using a Bird Film Applicator. The coating is then dried.

A 1 micron layer of vitreous selenium is formed over the photogenerated hole material by conventional vacuum deposition technique such as those disclosed by Bixby in U.S. Pat. No. 2,753,278 and U.S. Pat. No. 2,970,906.

A stock solution containing 1 gram of 2,4,7-trinitro-9-fluorenone (TNF) and 1 gram of a polyester resin is made by dissolving the TNF and polyester in a solution of 66 ml of chloroform. This solution was then evaporated at 60° C. to half its volume or about 35 ml. This TNF/polyester solution is coated over the vitreous selenium layer to form a dried layer thickness of about 3 microns thick.

EXAMPLE VI

A second plate is made by the method of Example V except that the TNF/polyester layer is formed adjacent the substrate with the selenium layer on top and the photogenerated hole transport layer formed last as the top layer.

The plates of Examples V and VI are tested electrically by charging the plates to fields of 33 and 55 volts/micron, respectively, and discharged at a wavelength of 4200 A at $2 \times 10^{10}$ photons/cm$^2$/sec. The plates exhibit satisfactory discharge at both fields and are capable for use in forming visible images.

EXAMPLE VII

A photosensitive layered structure similar to that illustrated in FIG. 1 consisting of an aluminized Mylar substrate, having a 22 micron thick layer of a photogenerated hole transport comprising 25 percent by weight of N,N'-diphenyl-N,N'-bis(3-methylphenyl)-[1,1,'-biphenyl]-4,4'-diamine and 75 percent by weight bisphenol-A-polycarbonate (Lexan 145, obtained from General Electric Company) over the substrate, a 1 micron layer of amorphous selenium over the photogenerated hole transport material and a 3 micron layer of TNF/polyester as a top layer is prepared by the following technique:

A photogenerated hole transport layer is prepared by dissolving in 135 grams of methylene chloride, 3.34 grams of N,N'-diphenyl-N,N'-bis(3-methylphenyl)-[1,1'-biphenyl]-4,4'-diamine as prepared in Example II and 10 grams of bisphenol-A-polycarbonate (Lexan 145, obtained from General Electric Company). A layer of the above mixture is applied to an aluminized Mylar substrate using a Bird Film Applicator. The coating is then vacuum dried at 40° C. for 18 hours to form a 22 micron thin dry layer of charge transport material.

A 1 micron layer of vitreous selenium is formed over the photogenerated hole material by conventional vacuum deposition technique such as those disclosed by Bixby in U.S. Pat. No. 2,753,278 and U.S. Pat. No. 2,970,906.

A stock solution containing 1 gram of 2,4,7-trinitro-9-fluorenone (TNF) and 1 gram of a polyester resin is made by dissolving the TNF and polyester in a solution of 66 ml of chloroform. This solution was then evaporated at 60° C. to half its volume or about 35 ml. This TNF/polyester solution is coated over the vitreous selenium layer to form a dried layer thickness of about 3 microns thick.

EXAMPLE VIII

A second plate is made by the method of Example VII except that the TNF/polyester layer is formed adjacent the substrate with the selenium layer on top and the photogenerated hole transport layer formed last as the top layer.

The plates of Examples VII and VIII are tested electrically by charging the plates to fields of 33 and 55 volts/micron, respectively, and discharged at a wavelength of 4200 A at $2 \times 10^{12}$ photons/cm$^2$/sec. The plates exhibit satisfactory discharge at both fields and are capable for use in forming visible images.

EXAMPLE IX

A photosensitive layered structure similar to that illustrated in FIG. 1 consisting of an aluminized Mylar substrate, having a 22 micron thick layer of a photogenerated hole transport material comprising 25 percent by weight of N,N'-diphenyl-N,N'-bis(3-methylphenyl)-[2,2'-dimethyl-1,1'-biphenyl]-4,4'-diamine and 75 percent by weight bisphenol-A-polycarbonate (Lexan 145, obtained from General Electric Company) over the substrate, a 1 micron layer of amorphous selenium over the photogenerated holes transport material and a 3 micron layer of TNF/polyester as a top layer is prepared by the following technique:

A photogenerated hole transport layer is prepared by dissolving in 135 grams of methylene chloride, 3.34 grams of N,N'-diphenyl-N,N'-bis(3-methylphenyl)-[2,2'-dimethyl-1,1'-biphenyl]-4,4'-diamine as prepared in Example III and 10 grams of bisphenol-A-polycarbonate (Lexan 145, obtained from General Electric Company). A layer of the above mixture is formed on an aluminized Mylar substrate using a Bird Film Applicator. The coating is then vacuum dried at 40° C. for 18 hours to form a 22 micron thin dry layer of photogenerated hole transport material.

A 1 micron layer of vitreous selenium is formed over the photogenerated hole material by conventional vacuum deposition technique such as those disclosed by Bixby in U.S. Pat. No. 2,753,278 and U.S. Pat. No. 2,970,906.

A stock solution containing 1 gram of 2,4,7-trinitro-9-fluorenone (TNF) and 1 gram of a polyester resin is made by dissolving the TNF and polyester in a solution of 66 ml of chloroform. This solution was then evaporated at 60° C. to half its volume or about 35 ml. This TNF/polyester solution is coated over the vitreous selenium layer to form a dried layer thickness of about 3 microns thick.

EXAMPLE X

A second plate is made by the method of Example IX except that the TNF/polyester layer is formed adjacent the substrate with the selenium layer on top and the photogenerated hole transport layer formed last as the top layer.

The plates of Examples IV and X are tested electrically by charging the plates to fields of 33 and 55 volts/-micron, respectively, and discharging at a wavelength of 4200 A at $2 \times 10^{12}$ photons/cm$^2$/sec. The plates exhibit satisfactory discharge at both fields and are capable for use in forming visible images.

EXAMPLE XI

A photosensitive layered structure similar to that illustrated in FIG. 1 consisting of an aluminized Mylar substrate having a 22 micron thick layer of a photogenerated hole transport material comprising 25 percent by weight of bis(4-diethylamino-2-methylphenyl)-phenylmethane and 75 percent by weight bisphenol-A-polycarbonate (Lexan 145, obtained from General Electric Company) over the substrate; a 1 micron layer of amorphous selenium over the photogenerated hole transport material and a 3 micron layer of TNF/polyester as a top layer is prepared by the following technique:

A photogenerated hole transport layer is prepared by dissolving in 135 grams of methylene chloride, 3.34 grams of bis(4-diethylamino-2-methylphenyl)-phenylmethane as prepared in Example IV and 10 grams of bisphenol-A-polycarbonate (Lexan 145, obtained from General Electric Company). A layer of the above mixture is formed on an aluminized Mylar substrate by using a Bird Film Applicator. The coating is then vacuum dried at 40° C. for 18 hours to form a 22 micron thin dry layer of charge transport material.

A 1 micron layer of vitreous selenium is formed over the photogenerated hole material by conventional vacuum deposition technique such as those disclosed by Bixby in U.S. Pat. No. 2,753,278 and U.S. Pat. No. 2,970,906.

A stock solution containing 1 gram of 2,4,7-trinitro-9-fluorenone (TNF) and 1 gram of a polyester resin is made by dissolving the TNF and polyester in a solution of 66 ml of chloroform. This solution was then evaporated at 60° C. to half its volume or about 35 ml. This TNF/polyester solution is coated over the vitreous selenium layer to form a dried layer thickness of about 3 microns thick.

EXAMPLE XII

A second plate is made by the method of Example XI except that the TNF/polyester layer is formed adjacent the substrate with the selenium layer on top and the photogenerated hole transport layer formed last as the top layer.

The plates of Examples XI and XII are tested electrically by charging the plates to fields of 33 and 55 volts/-micron, respectively, and discharged at a wavelength of 4200 A at $2 \times 10^{12}$ photons/cm$^2$/sec. The plates exhibit satisfactory discharge at both fields and are capable for use in forming visible images.

Other modifications and ramifications of the present invention would appear to those skilled in the art upon reading the disclosure. These are also intended to be within the scope of the present invention.

What is claimed is:

1. An imaging member comprising a first layer of electrically active charge transport material contained on a supporting substrate, a photoconductive layer overlying said active layer, and a second layer of electrically active charge transport material overlying said photoconductive layer, said photoconductive layer exhibiting the capability of photogeneration of charge carriers and injection of said charge carriers, one of said electrically active layers comprising electrically inactive resinous material having dispersed therein from about 15 to about 75 percent by weight of N,N'-diphenyl-N,N'-bis(phenylmethyl)-[1,1'-biphenyl]-4,4'-diamine and capable of supporting the injection of photogenerated holes from said photoconductive layer and transporting said holes through said layer and the other electrically active layer capable of supporting the injection of photogenerated electrons from said photoconductive layer and transporting said electrons through said layer.

2. The member according to claim 1 wherein the electrically inactive resinous material is a polycarbonate resin.

3. The member according to claim 2 wherein the polycarbonate resin has a $M_w$ of from about 20,000 to about 100,000.

4. The member according to claim 2 wherein the polycarbonate resin has a $M_w$ of from about 20,000 to about 50,000.

5. The member according to claim 2 wherein the polycarbonate resin has a $M_w$ of from about 50,000 to about 100,000.

6. The member according to claim 2 wherein the polycarbonate resin is poly(4,4'-isopropylidene-diphenylene carbonate) having a $M_w$ of from about 35,000 to about 40,000.

7. The member according to claim 2 wherein the polycarbonate resin is poly(4,4'-isopropylidene-diphenylene carbonate) having a $M_w$ of from about 40,000 to about 45,000.

8. The member according to claim 1 wherein said photoconductive layer comprises vitreous selenium.

9. The member according to claim 1 wherein said photoconductive layer comprises an alloy of arsenic-selenium.

10. The member according to claim 9 wherein said alloy of arsenic-selenium is dispersed in a resinous binder.

11. The member according to claim 1 wherein said photoconductive layer comprises an alloy of tellurium-selenium.

12. The member according to claim 11 wherein said alloy of tellurium-selenium is dispersed in a resinous binder.

13. The member according to claim 1 wherein said photoconductive layer comprises an alloy of arsenic-tellurium-selenium.

14. The member according to claim 13 wherein said alloy of arsenic-tellurium-selenium is dispersed in a resinous binder.

15. The member according to claim 1 wherein said photoconductive layer comprises trigonal selenium.

16. The member according to claim 15 wherein the trigonal selenium is dispersed in a resinous binder.

17. A method of imaging which comprises:

(a) providing an imaging member comprising a first layer of electrically active charge transport material contained on a supporting substrate, a photoconductive layer overlying said active layer, and a second layer of electrically active charge transport material overlying said photoconductive layer, said photoconductive layer exhibiting the capability of photogeneration of charge carriers and injection of said charge carriers, one of said electrically active layer comprising an electrically inactive resinous material having dispersed therein from about 15 to about 75 percent by weight of N,N'-diphenyl-N,N'-bis(phenylmethyl)-[1,1'-biphenyl]-4,4'-diamine and capable of supporting the injection of photogenerated holes from said photoconductive layer and transporting said holes through said layer and the other electrically active layer capable of supporting the injection of photogenerated electrons from said photoconductive layer and transporting said electrons through said layer;

(b) uniformly electrostatically charging said member, followed by;

(c) imagewise exposing said charged members to a source of activating radiation to which said photoconductive material is absorbing and to which said layers of electrically active material is non-absorbing, whereby the photogenerated charge carriers from said photoconductive material are injected into and are transported through said layers of electrically active material to form a latent electrostatic image on the surface of said member.

18. The method according to claim 17 wherein the electrically inactive resinous material comprises a polycarbonate resin.

19. The method according to claim 18 wherein the polycarbonate resin has a $M_w$ of from about 20,000 to about 100,000.

20. The method according to claim 18 wherein the polycarbonate resin has a $M_w$ of from about 20,000 to about 50,000.

21. The method according to claim 18 wherein the polycarbonate resin has a $M_w$ of from about 50,000 to about 100,000.

22. The method according to claim 18 wherein the polycarbonate resin is poly(4,4'-isopropylidene-diphenylene carbonate) having a $M_w$ of from about 35,000 to about 40,000.

23. The method according to claim 18 wherein the polycarbonate is poly(4,4'-isopropylidene-diphenylene carbonate) having a $M_w$ of from about 40,000 to about 45,000.

24. The method according to claim 17 wherein said photoconductive layer comprises vitreous selenium.

25. The method according to claim 17 wherein said photoconductive layer comprises an alloy of arsenic-selenium.

26. The method according to claim 25 wherein said alloy of arsenic-selenium is dispersed in a resinous binder.

27. The method according to claim 17 wherein said photoconductive layer comprises an alloy of tellurium-selenium.

28. The method according to claim 27 wherein said alloy of tellurium-selenium is dispersed in a resinous binder.

29. The method according to claim 17 wherein said photoconductive layer comprises an alloy of arsenic-tellurium-selenium.

30. The method according to claim 29 wherein said alloy of arsenic-tellurium-selenium is dispersed in a resinous binder.

31. The method according to claim 17 wherein said photoconductive layer comprises trigonal selenium.

32. The method according to claim 31 wherein the trigonal selenium is dispersed in a resinous binder.

* * * * *